US007571500B2

(12) United States Patent
Wu

(10) Patent No.: US 7,571,500 B2
(45) Date of Patent: Aug. 11, 2009

(54) INFLATING/DEFLATING DEVICE FOR AN INFLATABLE AIR MATTRESS

(76) Inventor: Hsin-Tsai Wu, 1F, No. 19, Alley 3, Lane 106, Sec. 3, Min-Chaun E. Rd., Taipei (TW)

( * ) Notice: Subject to any disclaimer, the term of this patent is extended or adjusted under 35 U.S.C. 154(b) by 660 days.

(21) Appl. No.: 11/271,250

(22) Filed: Nov. 9, 2005

(65) Prior Publication Data

US 2007/0104592 A1 May 10, 2007

(51) Int. Cl.
*A47C 27/08* (2006.01)
*F04B 35/04* (2006.01)

(52) U.S. Cl. ..... 5/173; 417/411; 417/423.14; 141/197

(58) Field of Classification Search ..... 417/411, 417/423.14; 5/713; 141/197
See application file for complete search history.

(56) References Cited

U.S. PATENT DOCUMENTS 6,530,751 B1 * 3/2003 Song et al. ..... 417/26
2004/0117912 A1 * 6/2004 Chung ..... 5/713
2004/0241014 A1 * 12/2004 Yen ..... 417/360
2005/0079077 A1 4/2005 Tsai et al.

FOREIGN PATENT DOCUMENTS

GB 2378987 2/2003
WO WO 2005/000074 1/2005

OTHER PUBLICATIONS

UK Search Report.

* cited by examiner

*Primary Examiner*—Devon C Kramer
*Assistant Examiner*—Peter J Bertheaud
(74) *Attorney, Agent, or Firm*—Brinks Hofer Gilson & Lione

(57) ABSTRACT

An inflating/deflating device includes a fan unit disposed inside a main housing. A release valve assembly is connected to a deflating port of the main housing for fluid communication with a first air passage of the fan unit. An inlet valve assembly is connected to an inflating port of the main housing for fluid communication with a second air passage of the fan unit. A control unit is provided to control the release and inlet valve assemblies. The control unit is operable to switch a first or a second actuating position. The control unit actuates the fan unit and the inlet valve assembly to perform an inflating mode in the first actuating position, and actuates the fan unit and the release valve assembly to perform a deflating mode in the second actuating position.

13 Claims, 12 Drawing Sheets

INFLATING/DEFLATING DEVICE FOR AN INFLATABLE AIR MATTRESS

CROSS-REFERENCE TO RELATED APPLICATIONS

This application claims the benefit of People's Republic of China Application No. 200520062638.4, filed Aug. 5, 2005. The disclosure of the above application is incorporated herein by reference.

BACKGROUND OF THE INVENTION

1. Field of the Invention

This invention relates to an inflating/deflating device for an inflatable, more particularly to a power-operated inflating/deflating device.

2. Description of the Related Art

Referring to FIGS. 1 and 2, there is shown an inflating/deflating device 12 attached to an air mattress 11 in an opening 111. The inflating/deflating device 12 includes a housing 13 and a fan unit 14 mounted removably inside the housing 13 to supply air. The housing 13 includes a space 131 to receive the fan unit 14, a pressure inlet gate 132 and a pressure release gate 133. An inlet valve assembly 134 is attached to a rear side of the housing 13 and communicated fluidly with the pressure inlet gate 132. A cap 135 is connected to the housing 13 to block releaseably the pressure release gate 133. Both of the pressure inlet and pressure release gates 133, 134 are in fluid communication with an interior chamber of the air mattress 11. The pressure inlet valve 134 is used to guide air into the air mattress 11 and to prevent air from flowing outwardly and reversely.

The fan unit 14 includes a fan casing 143 to receive a motor (not shown) and a fan blade assembly (not shown) and is provided with an inlet passage 141 to be aligned with the pressure inlet gate 132 and an outlet passage 142 to be aligned with the pressure release gate 133.

When the air mattress 11 is to be inflated, the fan unit 14 is placed in the housing 13 with the inlet passage 141 being aligned with the pressure inlet gate 132 and is actuated to introduce air into the air mattress 11 through the pressure inlet gate 132 and the inlet valve assembly 134.

When the air mattress 11 is to be deflated, the cap 135 is detached from the pressure release gate 133, and the outlet passage 142 of the fan unit 14 is aligned with the pressure release gate 133. Thereafter, the fan unit 14 is actuated to draw air from the inside of the air mattress 11 through the pressure release gate 133.

However, inconveniences are encountered when using the conventional inflating/deflating device 12 since it is necessary to remove the fan unit 14 from the housing 13 to change the position of the fan unit 14 relative to the housing 13 whenever inflation or deflation of the air mattress 11 is necessary. It is desirable that an inflating/deflating device be operable to perform an inflating mode and a deflating mode without the need to change the configuration of the inflating/deflating device by detaching a portion of the inflating/deflating device from an inflatable.

SUMMARY OF THE INVENTION

An object of the present invention is to provide an inflating/deflating device with a control unit to switch from an inflating mode to a deflating mode and vice versa.

Accordingly, an inflating/deflating device according to the present invention comprises: a main housing adapted to be mounted on an inflatable and having an inflating port and a deflating port; a fan unit disposed inside the main housing and having first and second air passages; a release valve assembly connected to the deflating port and capable of fluid communication with the first air passages; an inlet valve assembly connected to the inflating port and capable of fluid communication with the second air passages; and a control unit disposed in the main housing to control the release and inlet valve assemblies. The control unit is operable to switch to a first or a second actuating position. The control unit actuates the fan unit and the inlet valve assembly to perform an inflating mode in the first actuating position, and actuates the fan unit and the release valve assembly to perform a deflating mode in the second actuating position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
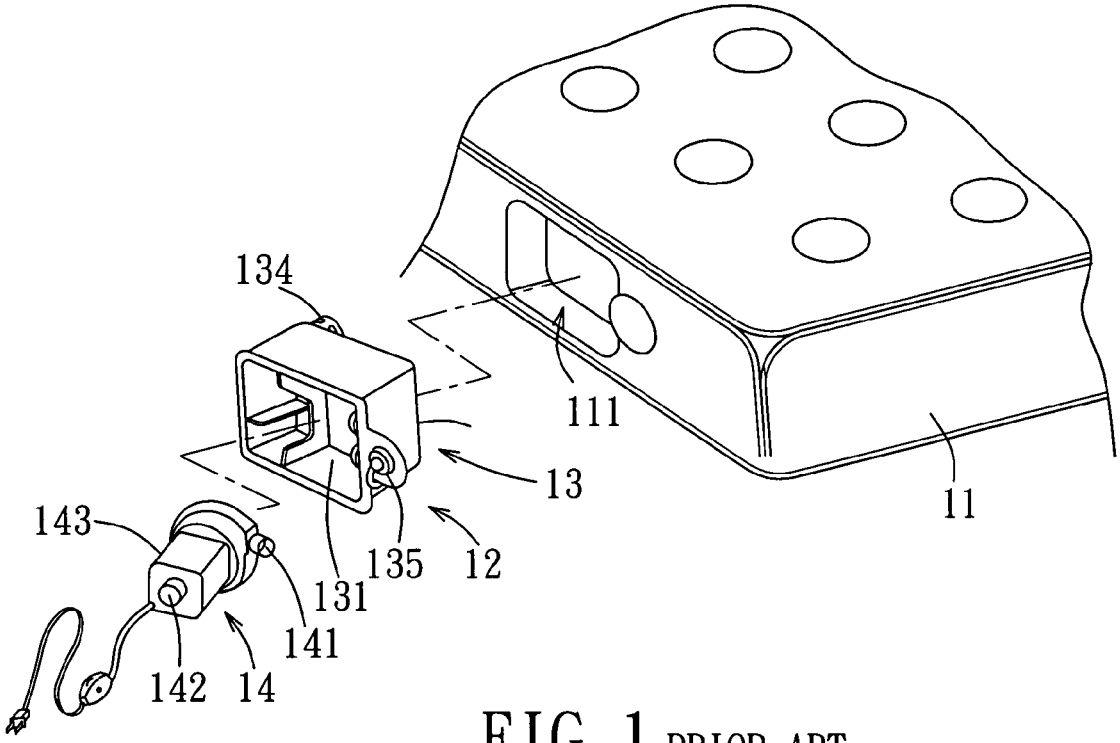
FIG. 1 PRIOR ART
FIG. 1 shows a conventional inflating/deflating device for assembly with an air mattress.
Figure 2:
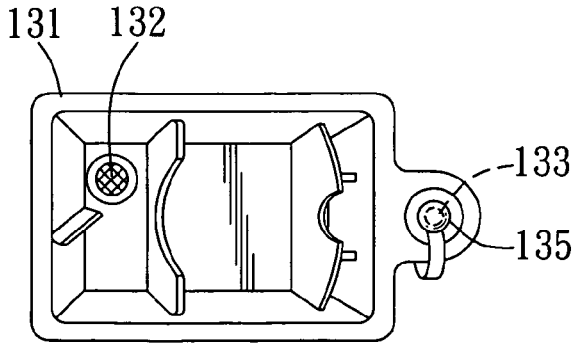
FIG. 2 PRIOR ART
FIG. 2 is an elevation view of a housing of the conventional inflating/deflating device of FIG. 1.
Figure 3:
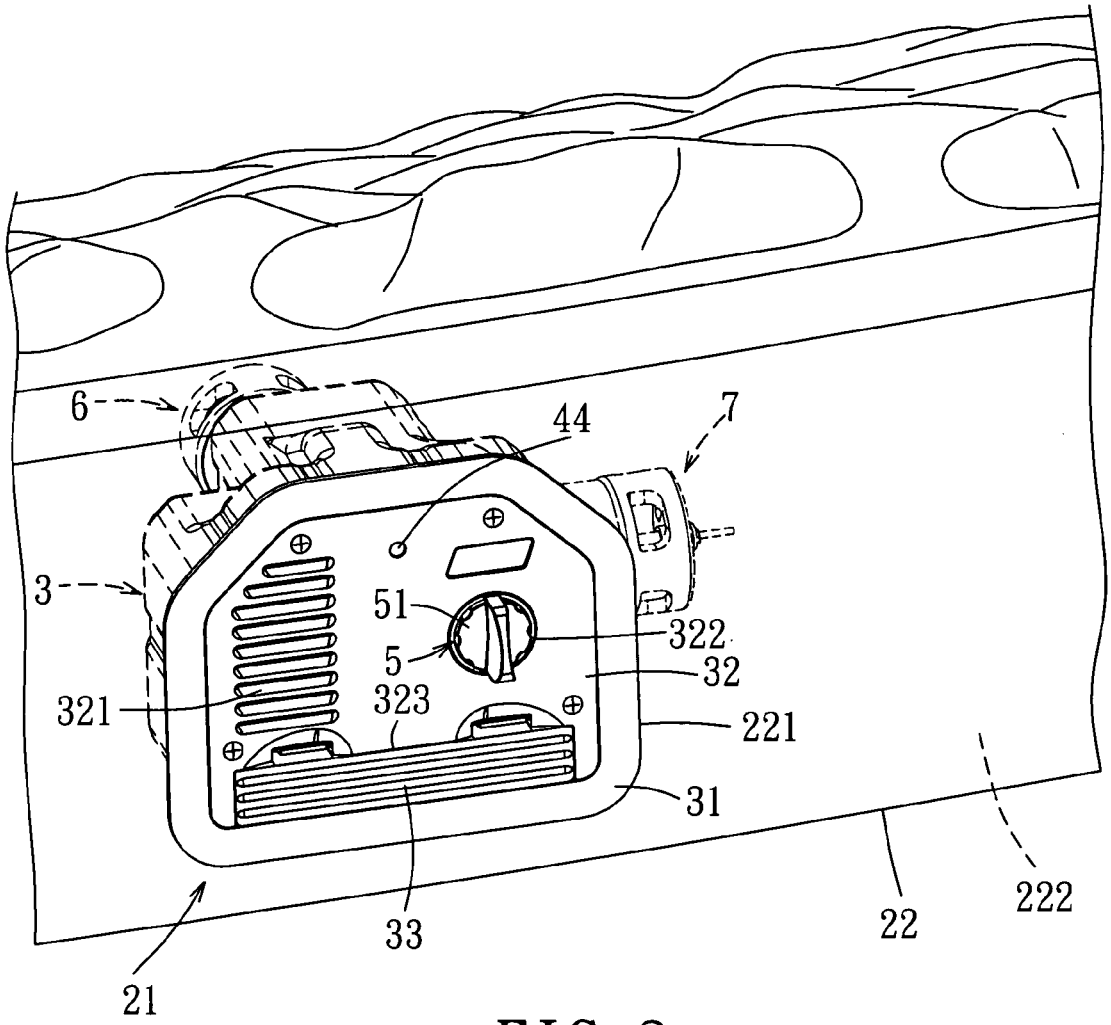
FIG. 3 is a perspective view showing an air mattress and an inflating/deflating device embodying the present invention.
Figure 4:
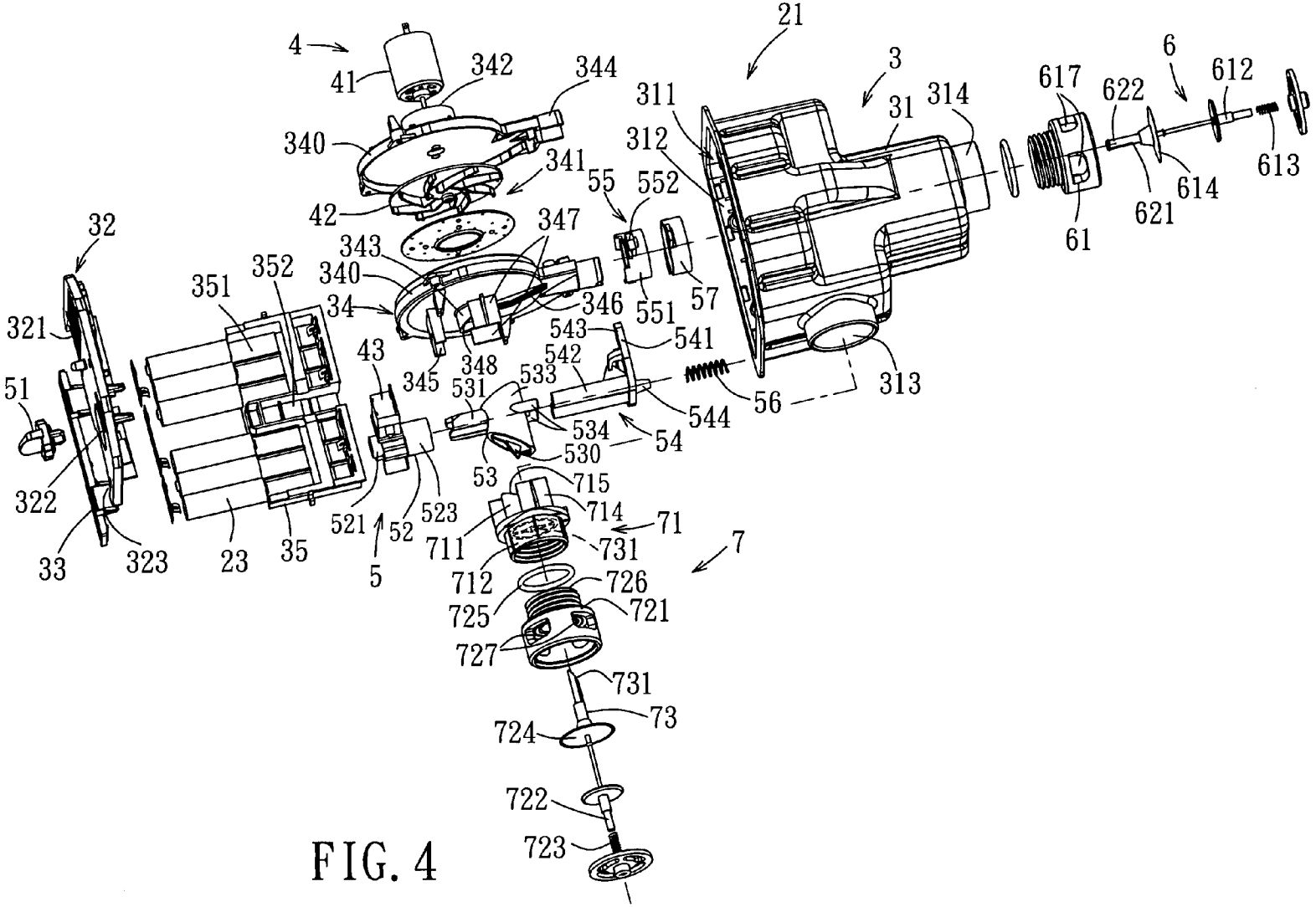
FIG. 4 is an exploded view of the inflating/deflating device of FIG. 3.
Figure 7:
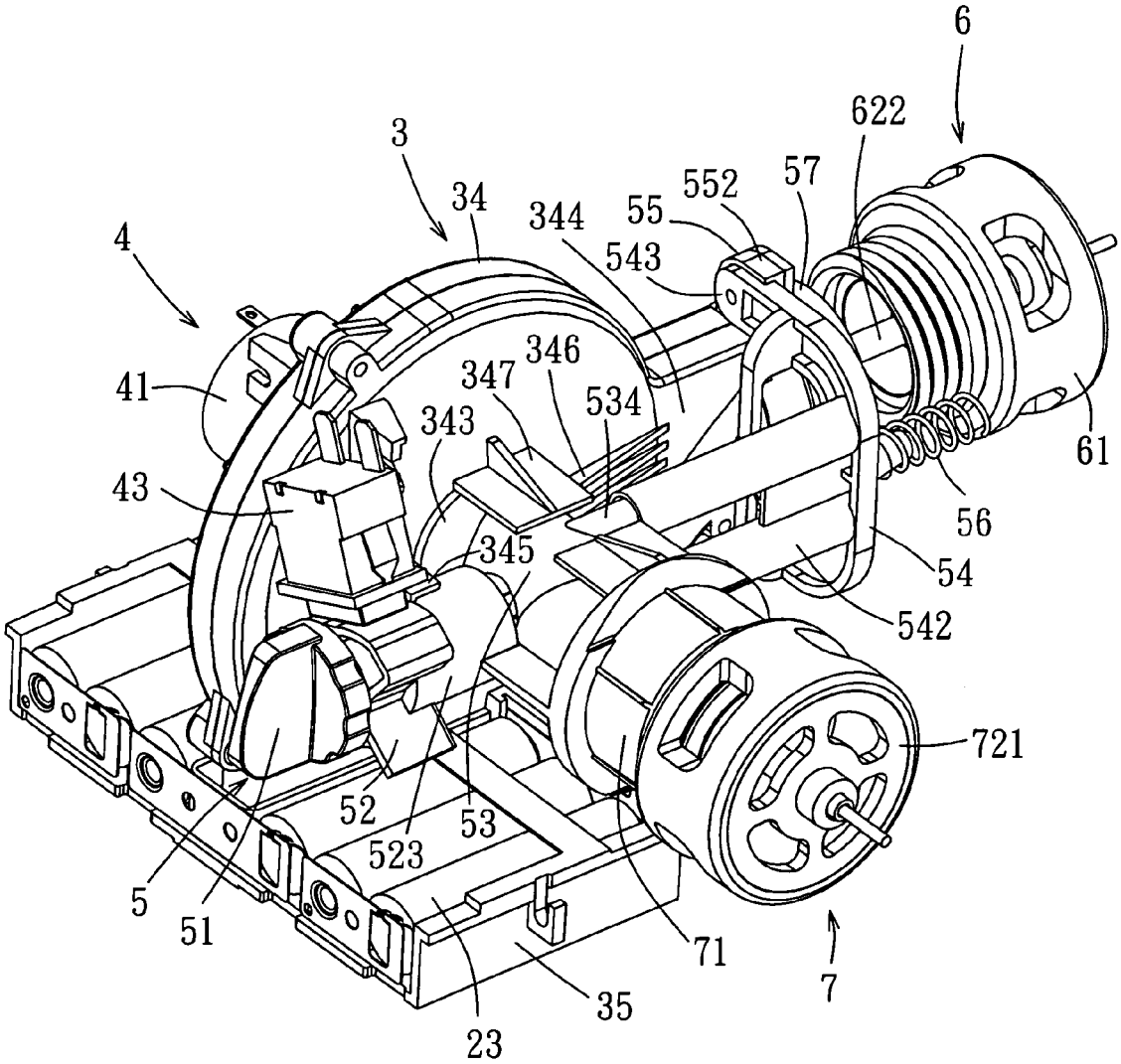
FIG. 7 is a perspective view of the inflating/deflating device of FIG. 3 with a main housing being removed.

Referring to FIGS. 3, 4 and 7, there is shown an inflating/deflating device 21 according to a preferred embodiment of the present invention. The inflating/deflating device 21 is attached to an air mattress 22 and is operated through a power source to perform an inflating mode and a deflating mode. The air mattress 22 is an air mattress which has an air chamber 222 and an opening 221. The inflating/deflating device 21 includes a main housing 3, a fan unit 4, a control unit 5, an inlet valve assembly 6 and a release valve assembly 7. The control unit 5 is operable to control the fan unit 4, and the inlet and release valve assemblies 6 and 7.

The main housing 3 includes an outer shell 31 confining an air chamber 311, and a front panel 32. The front panel 32 is attached to the outer shell 31 to close a front opening 312 of the outer shell 31. A deflating port 313 and an inflating port 314 are disposed respectively at the right side and the rear side of the outer shell 31. A plurality of vent holes 321 and a positioning hole 322 are provided in the front panel 32. A cutout 323 is provided in the front panel 32 and is covered by a cover plate 33 which is attached removably to the front panel 32 to close the cutout 323.

A fixed base 35 is fixed inside the outer shell 31 proximate to the cutout 323 of the front panel 32 and includes a battery receptacle 351 to receive a battery power source 23 and a groove 352 to position the fan unit 4. The cutout 323 provided in the front panel 32 provides an access to the battery receptacle 351. Alternatively, the front panel 32 may be provided with an electric socket for electrical connection with an external power source operated by an alternating current or a direct current.

Figure 8:
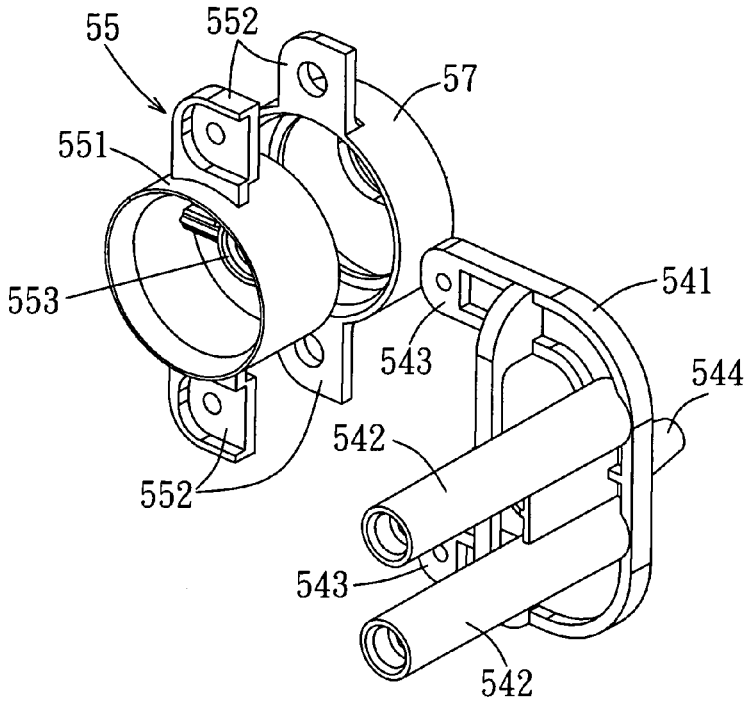
FIG. 8 is an exploded view showing a pusher and a second connector of the inflating/deflating device of FIG. 3.
Figure 10:
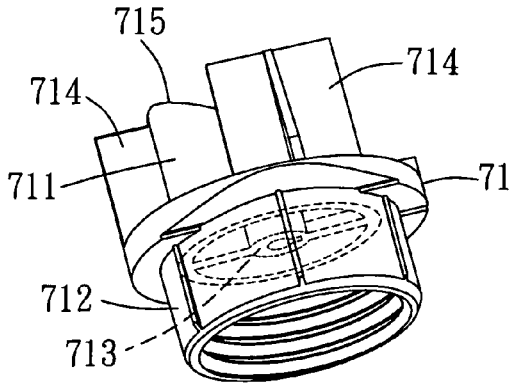
FIG. 10 is a perspective view of a tubular coupler of a release valve assembly shown in FIG. 3.
Figure 12:
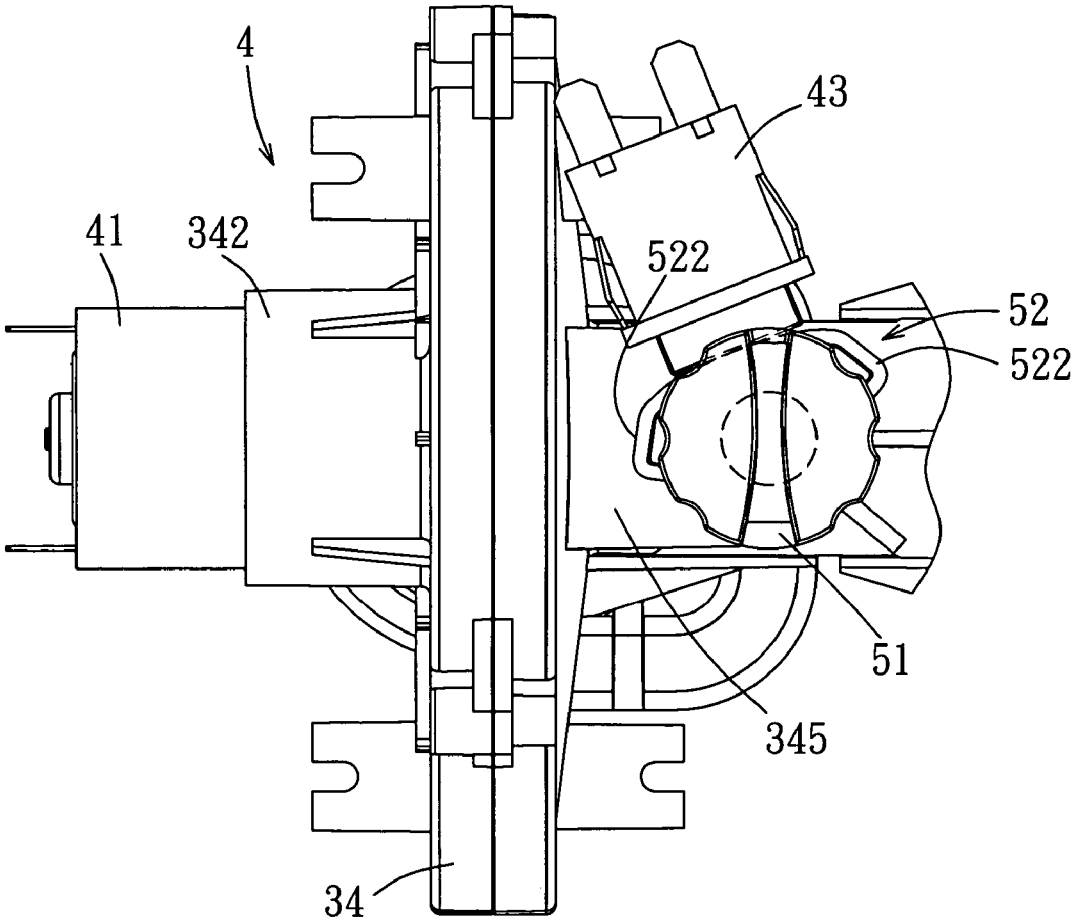
FIG. 12 is a fragmentary view showing a fan casing, a control knob, a switch and the actuator of the inflating/deflating device of FIG. 3.

The fan unit 4 includes a fan casing 34 fixed to the groove 352 of the fixed base 35. The fan casing 34 is composed of two casing parts 340 defining a space 341. A bearing unit 342, a first air passage 343 and a second air passage 344 are provided respectively at the left, right and rear sides of the fan casing 34. A retaining part 345 and a guide part 346 are provided respectively on two opposite sides of the first air passage 343. Two clamp parts 347 are provided respectively t below and above the first air passage 343. The first and second air passages 343 and 344 are communicated fluidly with the space 341 of the fan casing 34 and the air chamber 311 of the main housing 3. The first air passage 343 is formed as a tube whose end is beveled to form an inclined annular slide face 348, as best shown in FIGS. 8, 10 and 12.

The fan unit 4 further includes a motor 41 supported by the bearing unit 342, and a fan blade assembly 42 disposed inside the fan casing 34 and driven by the motor 41, a switch 43 disposed on the right side of the fan casing 34 and connected electrically to the battery power source 23 to control the motor 41, and an indicator 44 disposed on the front panel 32 and connected electrically to the battery power source 23. In this embodiment, the indicator 44 is an indicator lamp.

The control unit 5 includes a control knob 51 disposed rotatably in the positioning hole 322 of the front panel 32, an actuator 52 connected to the control knob 51 and disposed inside the main housing 3, a first connector 53 disposed between the first air passage 343 and the release valve assembly 7, and a second connector 55 disposed between the second air passage 344 and the inlet valve assembly 6. The first connector 53 is connected to and disposed rearwardly of the actuator 52. A pusher 54 is connected to and is disposed rearwardly of the first connector 53. The second connector 55 is connected to the pusher 54 and disposed rearwardly of the second air passage 344 of the fan casing 34. A spring 56 is sleeved onto the rear end of the pusher 54.

Figure 5:
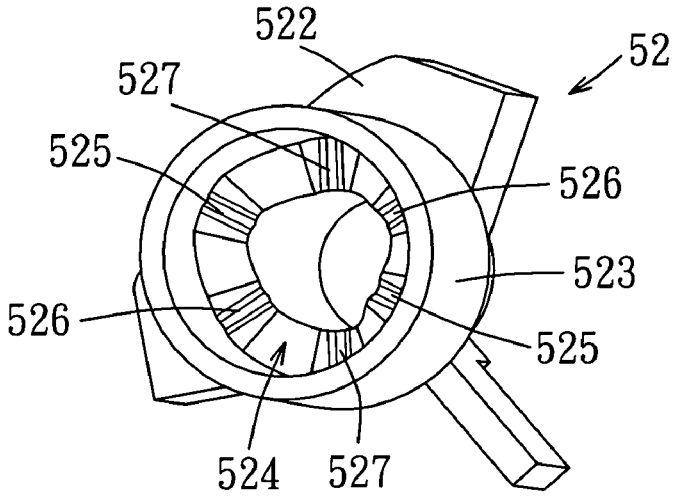
FIG. 5 is a perspective view of an actuator of the inflating/deflating device of FIG. 3.
Figure 11:
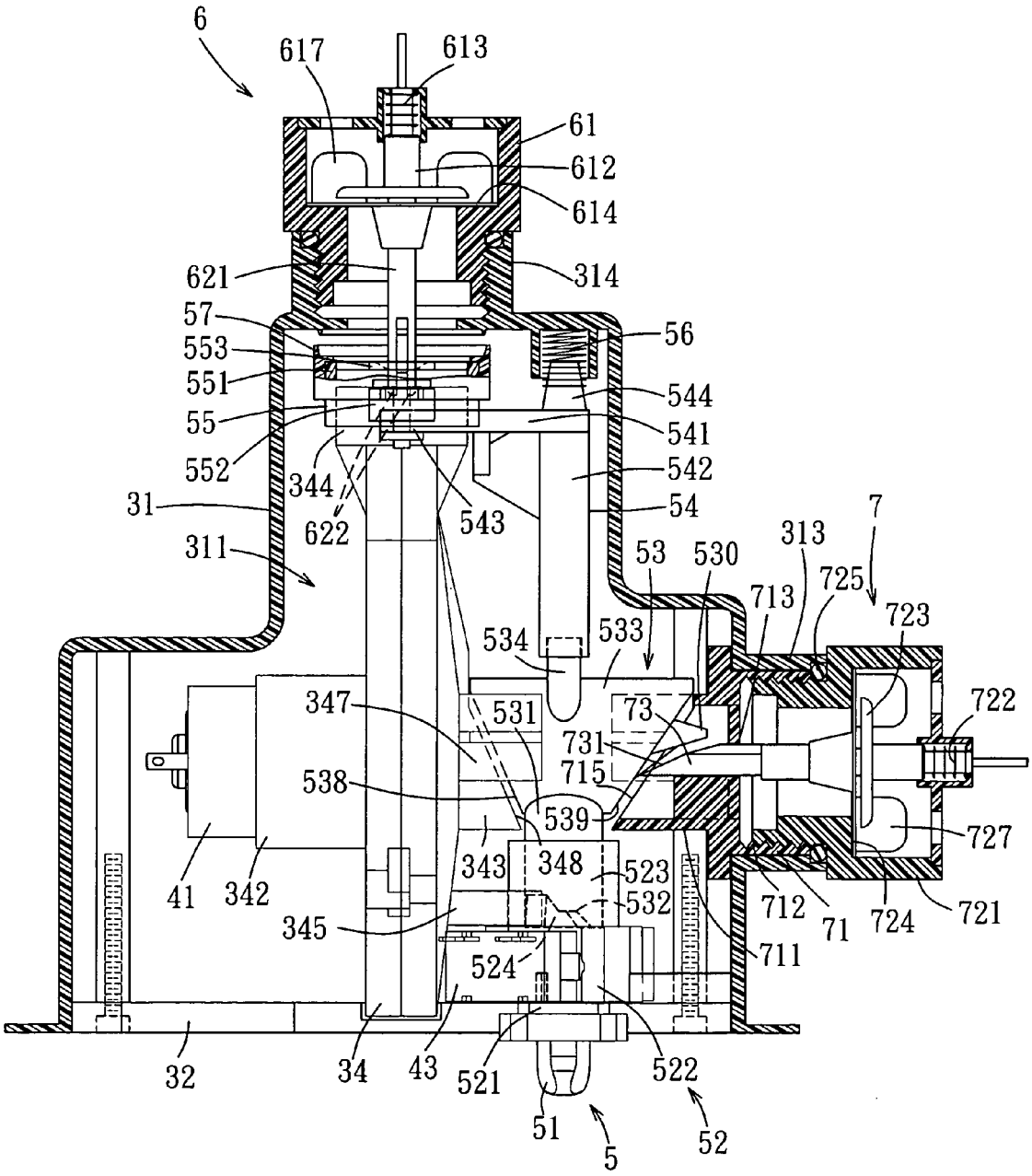
FIG. 11 is a sectional view of the inflating/deflating device of FIG. 3.

Referring to FIGS. 5 and 11 in combination with FIGS. 3, 4 and 7, the actuator 52 is supported rotatably by the retaining part 345 of the fan casing 34 and includes a first sleeve part 521 connected to the control knob 51, a pair of switch actuating elements 522 projecting from the first sleeve part 521 to press the switch 43 of the fan unit 4, a second sleeve part 523 connected to the first sleeve part 521, and two toothed cam surfaces 524 disposed on an inner surface of the second sleeve part 523.

Each toothed cam surface 524 includes first, second and third teeth 525, 526, and 527. The second tooth 526 is connected between the first and third teeth 525 and 527 and is higher than the first and third teeth 525, 527. The first tooth 525 is higher than the third tooth 527.

Figure 6:
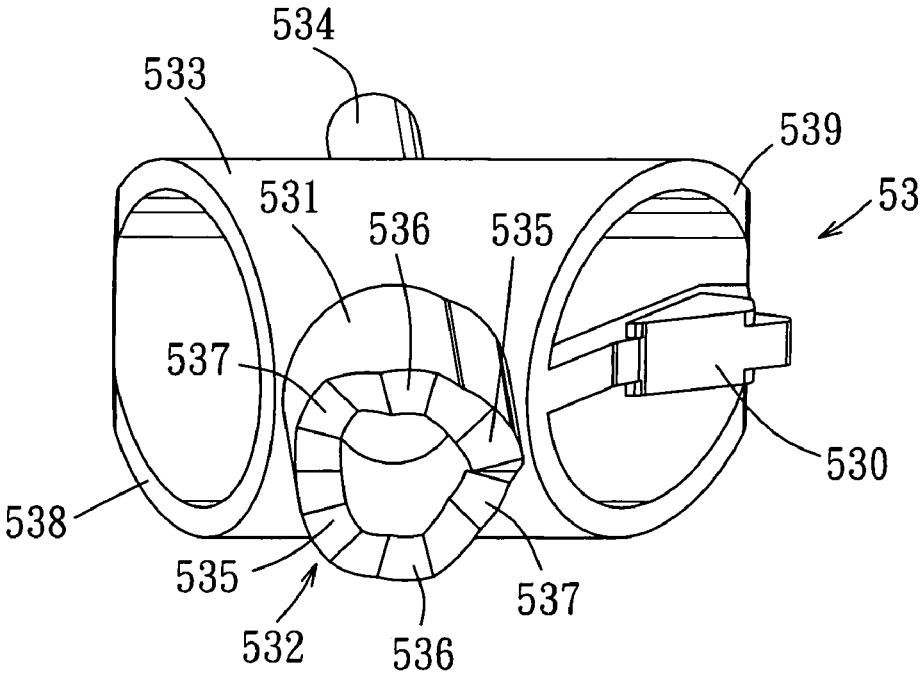
FIG. 6 is a perspective view of a first connector of the inflating/deflating device of FIG. 3.

Referring to FIGS. 6 and 11 in combination with FIGS. 3, 4 and 7, the first connector 53 is supported movably on the fan casing 34 proximate to the first air passage 343. In particular, the first connector 53 has a tubular member 533 which is held movably by the two clamping parts 347 of the fan casing 34 and which may be aligned with the first air passage 343. The first connector 53 is normally biased to move forward and toward the actuator 52 by the spring 56 which will be further detailed hereinafter and can be actuated by the actuator 52 to move rearward and away from the actuator 52. The first connector 53 further includes a sleeve part 531 which projects forwardly and transversely from the tubular member 533 and which is inserted into the second sleeve part 523 of the actuator 52, two cam follower surfaces 532 formed on a front end of the sleeve part 531 and placed in contact with the toothed cam surfaces 524 of the actuator 52 through the action of the spring 56. The tubular member 533 further has two coupling parts 534 projecting rearwardly therefrom.

Each cam follower surface 532 of the first connector 53 includes first, second and third teeth 535, 536 and 537. The second tooth 536 is connected between the first and third teeth 535 and 537. The first tooth 535 is higher than the second and third teeth 536 and 537, and the second tooth 536 is higher than the third tooth 537.

The tubular member 533 of the first connector 53 has a first open end to be aligned with the first air passage 343 of the fan unit 4 and an opposite second open end to be aligned with the release valve assembly 7. The first and second open ends of the tubular member 533 are beveled to form first and second inclined annular faces 538, 539, respectively so that the tubular member 533 tapers forwardly. A push element 530 is formed on the second inclined annular face 539 to push the release valve assembly 7 to an opening position. The first inclined annular face 538 of the first connector 53 may be in sealing contact with the inclined annular slide face 348 of the first air passage 343 when aligned with the inclined annular slide face 348.

Figure 9:
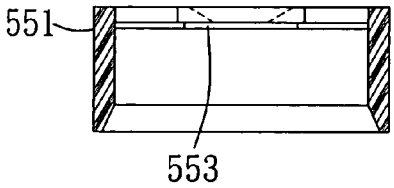
FIG. 9 is a sectional view of a ring body of the second connector.

Referring to FIGS. 8 and 9 in combination with FIGS. 3, 4, 7 and 11 the pusher 54 includes a push body 541, two front coupling parts 542 connected to the push body 541 and each having a front end coupled with one of the coupling parts 534 of the first connector 53, two retainers 543 provided respectively on two ends of the push body 541, and a spring holder 544 projecting rearwardly from the push body 541. The spring 56 is sleeved onto the spring holder 544 so that the pusher 54 is biased to move the first connector 53 forwardly against the actuator 52.

The second connector 55 includes a ring body 551 sleeved slidably onto a tubular wall of the second air passage 344, and a sealing ring 57 connected to and extending rearwardly from the ring body 551. The ring body 551 has two opposite connecting parts 552 projecting from the outer periphery thereof and corresponding in position to the retainers 543 of the pusher 54, and an annular limiting element 553 formed inside the ring body 551. The connecting parts 552 of each of the ring body 551 and the sealing ring 57 are connected respectively to the retainers 543 of the pusher 54 so that the second connector 55 can be moved by the pusher 54. The sealing ring 57 is made of rubber and is sleeved integrally around the ring body 551. The sealing ring 57 is movable toward or away from the inlet valve assembly 6 when the pusher 54 moves rearward or forward.

The inlet valve assembly 6 includes an inlet valve housing 61, and an inlet valve plunger 612. The inlet valve housing 61 is connected threadedly to the inflating port 314 of the outer shell 31. A plurality of apertures 617 are formed in the wall of the inlet valve housing 61 to be communicated fluidly with the air chamber 222 of the air mattress 22.

Figure 15:
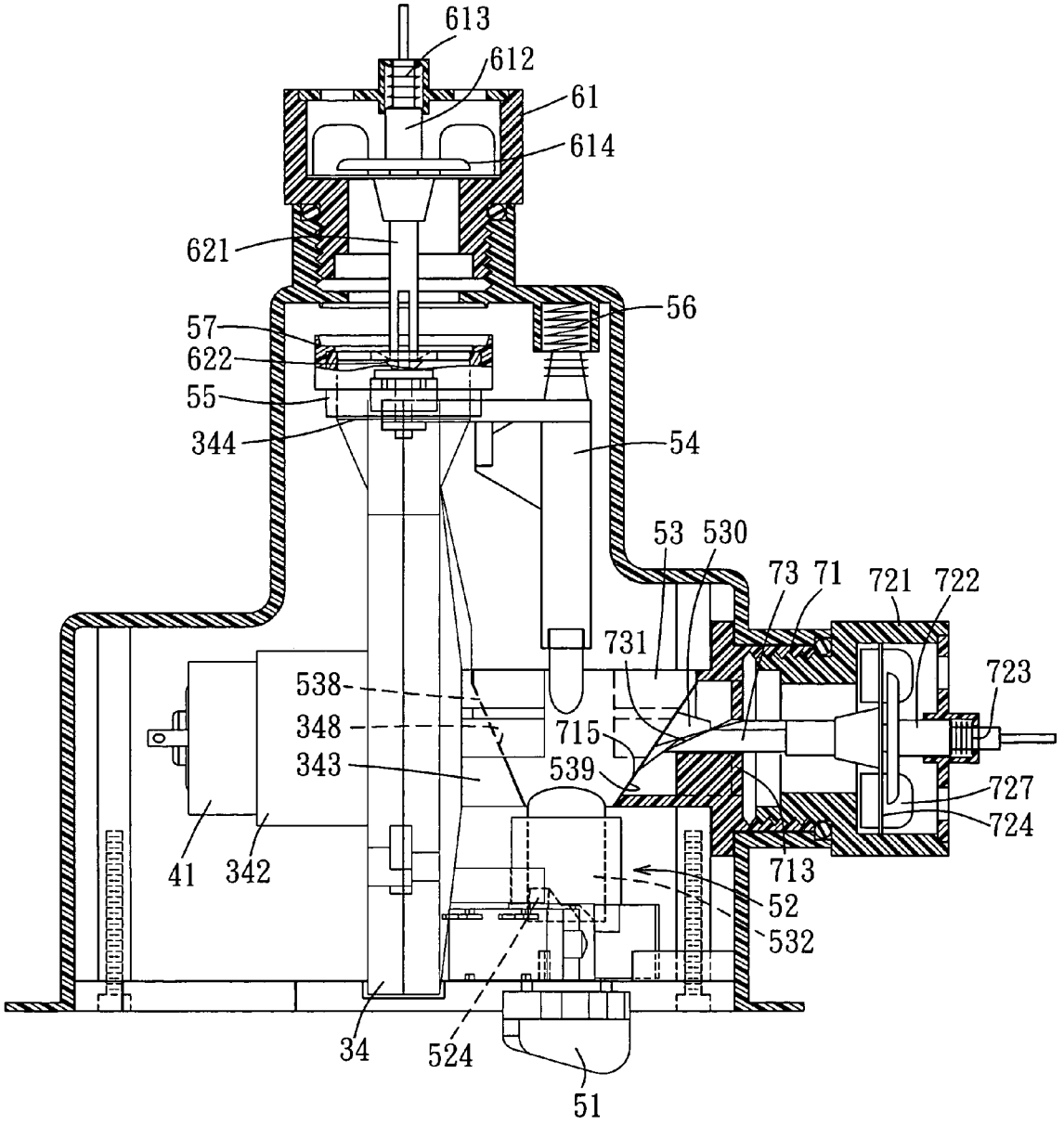
FIG. 15 is the same view as FIG. 11 but with the control unit 5 placed in a second actuating position.

The inlet valve plunger 612 is mounted movably inside the inlet valve housing 61 and is loaded with a spring 613. A rear end of the inlet valve plunger 612 extends outwardly of the inlet valve housing 61. A valve plate 614 is secured to the inlet valve plunger 612. A limit member 621 is connected to the inlet valve plunger 612 and extends forwardly through the annular limiting element 553 of the ring body 551. A front end of the limit member 621 has two engaging flanges 622 disposed forwardly of the annular limiting element 553 of the second connector 55. The spring 613 biases the inlet valve plunger 612 so that the valve plate 614 is normally moved to a closing position (FIGS. 11 and 15). When the valve plate 614 and the inlet valve plunger 612 are moved rearward against the biasing action of the spring 613 to an opening position (FIG. 13), the limit member 621 is moved rearward so that the engaging flanges 622 at the front end of the limit member 621 engage the annular limiting element 553. As such, the rearward movement of the valve plate 614 and the inlet valve plunger 612 is limited by the annular limiting element 553 of the ring body 551.

Referring to FIG. 10 in combination with FIGS. 3, 4, 7, and 11, the release valve assembly 7 includes a tubular coupler 71, a release valve housing 721, and a release valve plunger 722. The tubular coupler 71 includes a first sleeve part 711 inserted into the deflating port 313 of the main housing 3, a second sleeve part 712 connected to the first sleeve part 711, an annular guide plate 713 formed inside the first sleeve part 711, and upper and lower clamp parts 714 disposed on the first sleeve part 711 to clamp movably the second open end of the tubular member 533. The first sleeve part 711 has an open end which is beveled to form an inclined annular slide face 715 which faces the second inclined annular face 539 of the tubular member 533. The inclined annular slide face 715 can be placed in alignment and sealing contact with the second inclined annular face 539 when the first connector 53 is aligned with the tubular coupler 71.

The release valve housing 721 has an open end 726 connected threadedly to the second sleeve part 712 so that the release valve housing 721 is connected to the deflating port 313. A sealing ring 725 is provided to seal the connection between the release valve housing 721 and the second sleeve part 712. A plurality of through holes 727 are provided in the release valve housing 721 to communicate fluidly with the air chamber 222 of the air mattress 22.

The release valve plunger 722 is mounted movably in the release valve housing 721 and has one end portion extending outwardly of the release valve housing 721. A valve disc 724 is secured to the release valve plunger 722. A spring 723 is disposed around the release valve plunger 722 to bias the release valve plunger 722 so as to move the valve disc 724 to a closing position.

An abutment element 73 is connected to the release valve plunger 722 and extends through the annular guide plate 713 of the tubular coupler 71. The abutment element 73 has an abutment end 731 extending to the inclined annular slide face 715 of the first sleeve part 711 so that the abutment element 73 can be pushed by the push element 530 of the first connector 53 when the second open end of the first connector 53 is aligned with the first sleeve part 711.

Referring to FIGS. 11 and 12, the control knob 51 is in an OFF position so that the control unit 5 is in a non-actuating position and so that both of the switch actuating elements 522 of the actuator 52 are placed away from the switch 43. In this state, the fan unit 4 does not operate. The first teeth 525 of the toothed cam surface 524 contact against the respective first teeth 535 of the cam follower surfaces 532. The second teeth 526 of the toothed cam surfaces 524 contact against the respective second teeth 536 of the cam follower surfaces 532. The third teeth 527 of the toothed cam surfaces 524 contact against the respective third teeth 537 of the cam follower surfaces 532. As a result, the first inclined annular surface 538 of the first connector 53 is out of alignment with the inclined annular face 348 of the first air passage 343, and the second inclined annular surface 539 of the first connector 53 is out of alignment with the inclined annular face 715 of the first sleeve part 711 of the tubular coupler 71. The second connector 55 is moved away from the inlet valve assembly 6 so that the sealing ring 57 does not provide a fluid seal between the second connector 55 and the inlet valve assembly 6. In addition, the engaging flanges 622 of the limit member 621 is moved away from the annular limit element 553 of the second connector 55.

Figure 13:
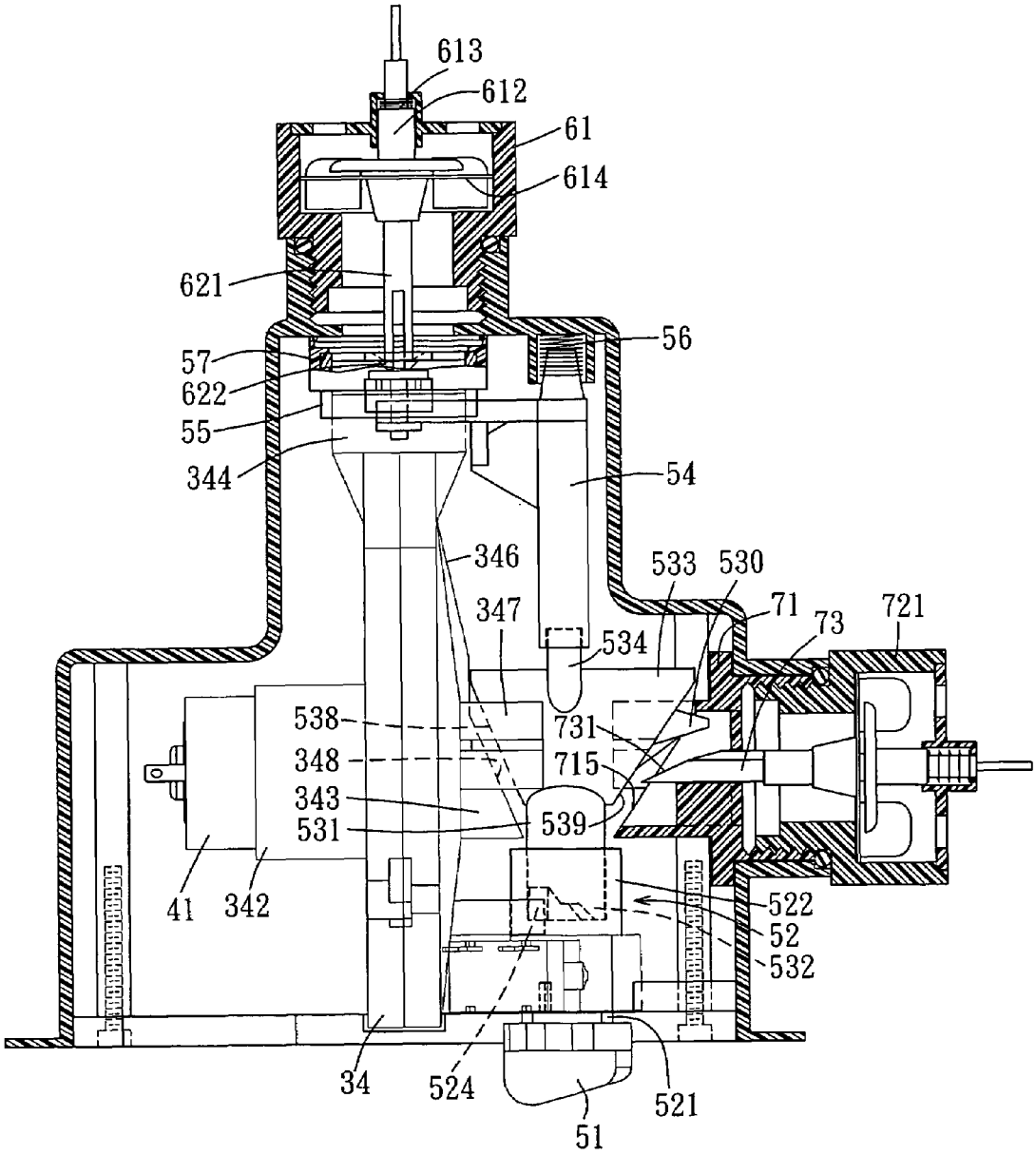
FIG. 13 is the same view as FIG. 11 but with the control unit 5 placed in a first actuating position.
Figure 14:
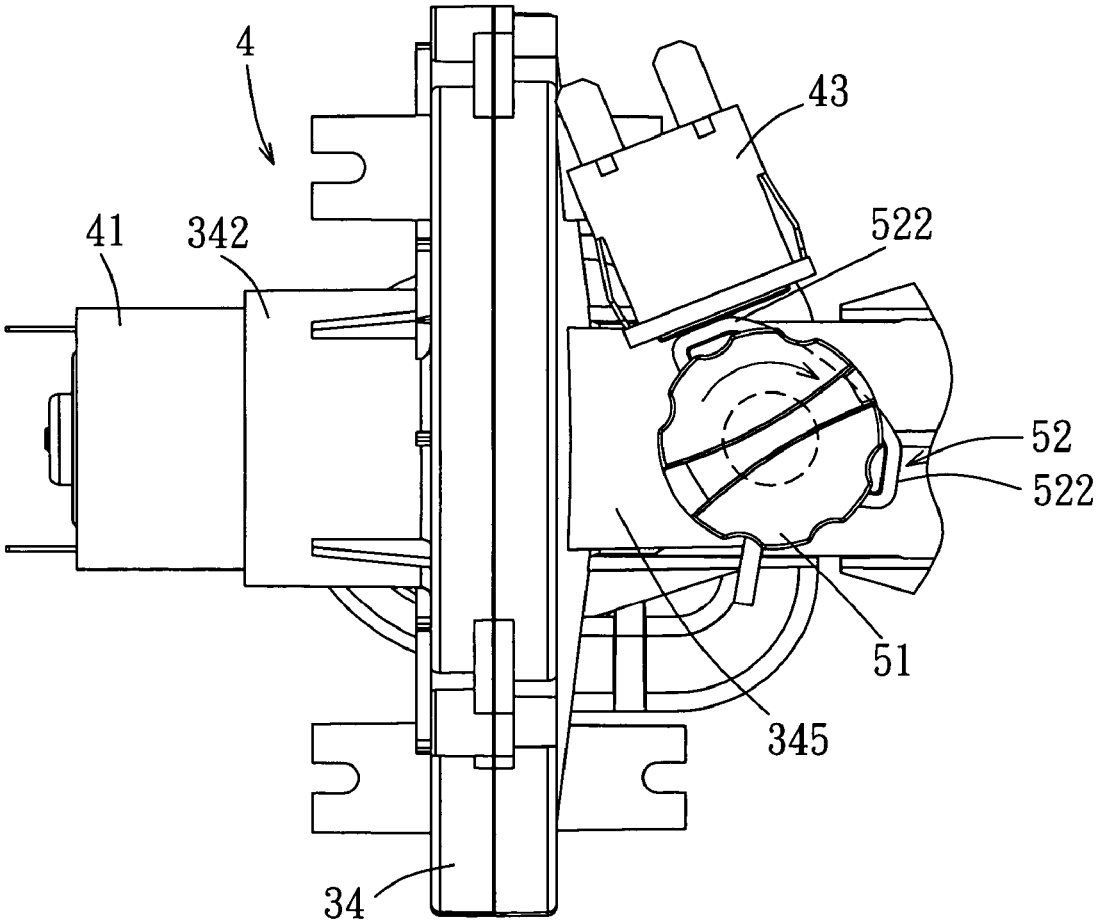
FIG. 14 is the same view as FIG. 12, but with the control knob being rotated clockwise.

Referring to FIGS. 13 and 14, when the control knob 51 placed in the position shown in FIG. 9 is rotated clockwise to a position shown in FIG. 11, the control unit 5 is in its first actuating position. The control knob 51 turns the actuator 52 so that one of the switch actuating element 522 of the actuator 52 presses the switch 43. The toothed cam surfaces 524 of the actuator 52 move the first connector 53 and the pusher 54 rearward against the spring 56 so that the ring body 551 and the sealing ring 57 of the second connector 55 are also moved rearward and placed in a sealing relationship with the inlet valve housing 61.

In this state, the first teeth 525 of the actuator 52 contact against the respective third teeth 537 of the first connector 53, the second teeth 526 of the actuator 52 contact against the respective first teeth 535 of the first connector 53, and the third teeth 527 of the actuator 52 contact against the respective second teeth 536 of the first connector 53.

As the switch 43 is pressed, the fan unit 4 is actuated to blow air into the inlet valve housing 61 through the second air passage 344 and the second connector 55. When air flows into the inlet valve housing 61, the valve plate 614 is pushed rearward to an opening position so that air flows through the inlet valve assembly 6 to inflate the air mattress 22. Upon completion of the inflation, the control knob 51 is rotated to a position shown in FIG. 9.

Figure 16:
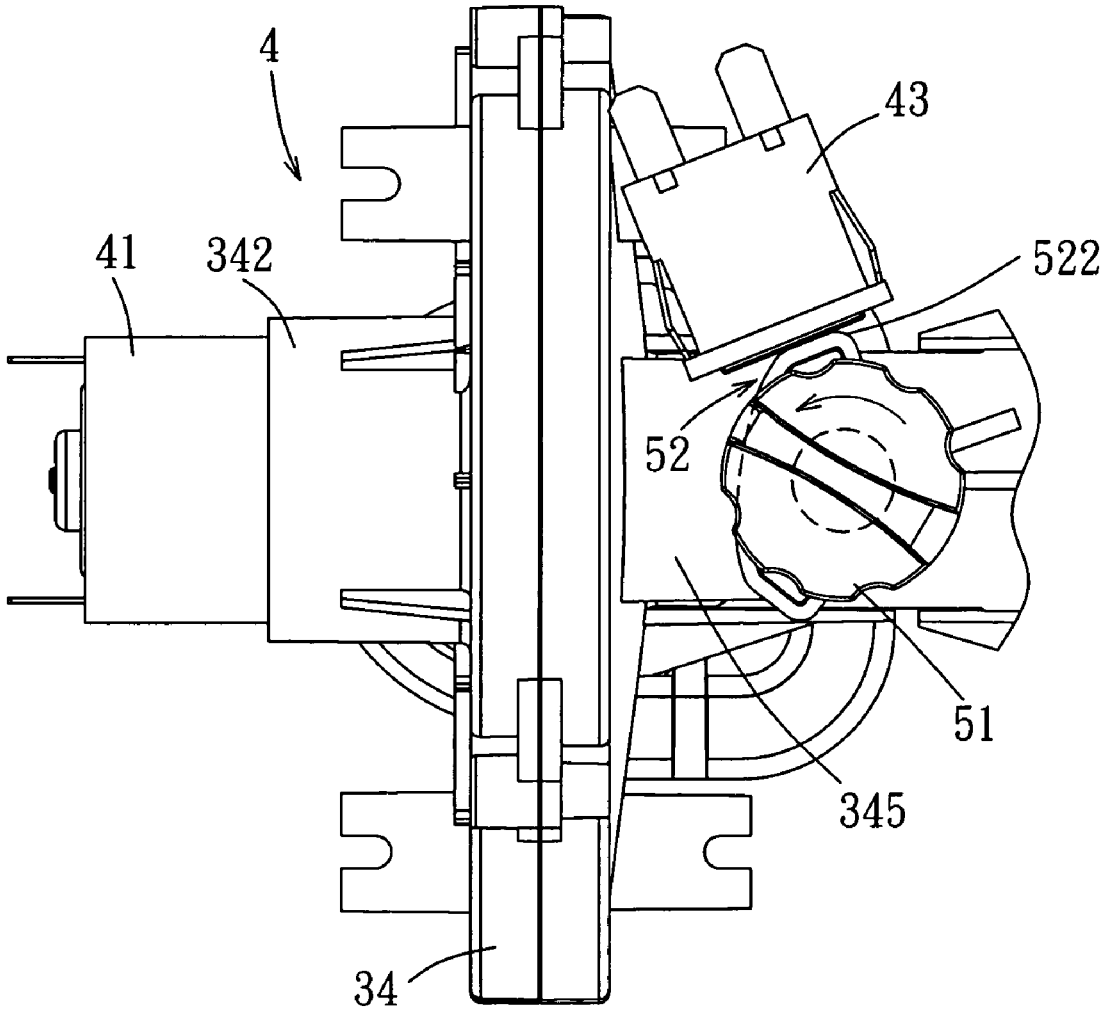
FIG. 16 is the same view as FIG. 12, but with the control knob being rotated counterclockwise.

Referring to FIGS. 15 and 16, when the control knob 51 placed in the position shown in FIG. 9 is rotated counterclockwise, the control unit 5 is placed in its second actuating position. In this state, the other one of the switch actuating elements 522 of the actuator 52 presses the switch 43 to activate the fan unit 4. The first teeth 525 of the toothed cam surfaces 524 of the actuator 52 contact against the respective second teeth 536 of the first connector 53, the second teeth 526 of the actuator 52 contact against the respective third teeth 537 of the first connector 53, and the third teeth 527 of the actuator 52 contact against the respective first teeth 535 of the first connector 53. As a result, the toothed cam surfaces 524 of the actuator 52 permit the first connector 53 and the pusher 54 to move forward by the action of the spring 56. The pusher 54 thus moves the second connector 55 forward and away from the inlet valve assembly 6.

Besides, the first and second inclined annular surfaces 538 and 539 of the tubular member 533 of the first connector 53 are in alignment with and in sealing contact with the inclined annular slide face 348 of the first air passage 343 and the inclined annular face 715 of the tubular coupler 71 of the release valve assembly 7, respectively. The push element 530 of the tubular member 533 pushes the abutment end 731 of the abutment element 73 so that the valve disc 724 is moved to its opening position. At the same time, the fan unit 4 draws air from the air mattress 22 through the release valve assembly 7, the first connector 53, and the first air passage 343 and to the second air passage 344 and the air chamber 311 of the main housing 3. Finally, air is discharged outwardly from the main housing 3 through the vent holes 321 in the front panel 3.

As mentioned above, the control unit 5 is operable to switch from a non-actuating position to a first actuating position or a second actuating position. In the non-actuating position, the control unit 5 neither activates the fan unit 4 nor actuates the inlet and release valve assemblies 6 and 7. In the first actuating position, the control unit 5 actuates the fan unit 4 and the inlet valve assembly 6 to perform an inflating mode. In the second actuating position, the control unit 5 actuates the fan unit 4 and the release valve assembly 7 to perform a deflating mode. Due to the control unit 5 used in the present invention, the inflating/deflating device 21 can be operated conveniently.

While the present invention has been described in connection with what is considered the most practical and preferred embodiments, it is understood that this invention is not limited to the disclosed embodiment but is intended to cover various arrangements included within the spirit and scope of the broadest interpretations and equivalent arrangements.

I claim:

1. An inflating/deflating device comprising:

a main housing adapted to be mounted on an inflatable and having an inflating port and a deflating port;

a fan unit disposed inside said main housing and having first and second air passages, and a switch;

a release valve assembly connected to said deflating port and capable of fluid communication with said first air passage; and an inlet valve assembly connected to said inflating port and capable of fluid communication with said second air passage;

a control unit disposed in said main housing to control said release and inlet valve assemblies;

wherein said control unit is operable to switch to a first or a second actuating position, said control unit actuating said fan unit and said inlet valve assembly to perform an inflating mode in said first actuating position, and actuating said fan unit and said release valve assembly to perform a deflating mode in said second actuating position;

wherein said control unit includes a first connector disposed between said first air passage and said release valve assembly and movable to activate said release valve assembly, a second connector disposed between said second air passage and said inlet valve assembly and movable toward or away from said inlet valve assembly, and an actuator operable to move said first and second connectors and to actuate said switch of said fan unit;

wherein said actuator has a toothed cam surface, said first connector having a cam follower surface in contact with said toothed cam surface, said first connector being movable in a direction toward or away from said actuator upon rotation of said actuator.

2. The inflating/deflating device of claim 1, wherein said main housing further includes a fixed base which is disposed inside said main housing and which has a battery receptacle, a front panel disposed at a front of said main housing, and a cutout provided in said front panel for access to said battery receptacle.

3. The inflating/deflating device of claim 1, wherein said main housing has a front panel, said actuator being provided inside said main housing to actuate said fan unit and said release and inlet valve assemblies, said control unit further including a control knob mounted on said front panel exteriorly of said main housing and connected to said actuator.

4. The inflating/deflating device of claim 1, wherein said actuator further includes a switch actuating element to press said switch.

5. The inflating/deflating device of claim 1, wherein said first connector further includes a tubular member having a first open end to be aligned with said first air passage, and a second open end to be aligned with said release valve assembly, and a sleeve part projecting forwardly and transversely from said tubular member between said first and second open ends.

6. The inflating/deflating device of claim 5, wherein said first second open ends of said tubular member are beveled so that said tubular member is tapered forwardly.

7. The inflating/deflating device of claim 5, further comprising a tubular coupler fitted in said deflating port of said main housing, said release valve assembly having a release valve housing connected to said tubular coupler, said first and second open ends of said tubular member being supported movably on said fan casing and said tubular coupler, respectively.

8. The inflating/deflating device of claim 7, wherein said first connector further includes a push element disposed on said second open end for pushing said release valve assembly to an opening position in said second actuating position of said control unit.

9. The inflating/deflating device of claim 8, wherein said release valve housing is connected sealingly to said tubular coupler and has a plurality of vent holes formed therein, said release valve assembly further having a release valve plunger disposed movably inside said release valve housing and incorporating a valve disc, said valve disc being normally biased to move to a closing position, said release valve plunger having an abutment element to be pushed by said push element of said first connector.

10. The inflating/deflating device of claim 1, wherein said second connector is disposed rearwardly of said second air passage and forwardly of said inlet valve assembly, said second connector having a ring body disposed slidably around said second air passage, and a sealing ring connected to and extending rearwardly from said ring body, said second connector being movable rearward or forward so that said sealing ring moves toward or away from said inlet valve assembly.

11. The inflating/deflating device of claim 10, wherein said control unit further includes a pusher connected to said first connector and said ring body of said second connector, said pusher moving said ring body when said actuator is moved.

12. The inflating/deflating device of claim 11, wherein said inlet valve assembly includes an inlet valve housing, and an inlet valve plunger mounted in said inlet valve housing and incorporating a valve plate, said valve plate being normally biased to move to a closing position.

13. The inflating/deflating device of claim 12, wherein said ring body has an annular limiting element inside said ring body, said inlet valve plunger having a limit member which extends forwardly through said annular limiting element and which has a front end to engage said annular limiting element when said valve plate is moved to an opening position.

* * * * *